United States Patent [19]

Lasne et al.

[11] 4,137,344

[45] Jan. 30, 1979

[54] METHOD OF ENAMELLING SHEETS

[75] Inventors: Claude Lasne, Antony; Alain Gernez, St. Jean de la Ruelle, both of France

[73] Assignee: Compagnie Generale d'Electricite S.A., Paris, France

[21] Appl. No.: 862,810

[22] Filed: Dec. 21, 1977

[30] Foreign Application Priority Data

Jan. 4, 1977 [FR] France ..... 77 00053

[51] Int. Cl.[2] ..... B65B 33/00

[52] U.S. Cl. ..... 427/156; 118/70; 198/494; 198/500; 427/154; 427/193; 427/374 F; 427/401

[58] Field of Search ..... 427/401, 154, 156, 193, 427/257, 374 D, 374 F, 424, 435, 445; 198/494, 500; 118/70

[56] References Cited

U.S. PATENT DOCUMENTS

| | | | |
|---|---|---|---|
| 2,560,270 | 7/1951 | Bird | 118/70 X |
| 3,109,439 | 11/1963 | Evans et al. | 118/70 UX |
| 3,727,290 | 4/1973 | Schaumburg | 427/193 X |
| 3,830,196 | 8/1974 | Guttman et al. | 118/70 |
| 3,909,289 | 9/1975 | Foucart et al. | 118/70 X |
| 3,927,460 | 12/1975 | Harada et al. | 427/156 X |
| 4,009,681 | 3/1977 | Heckman et al. | 118/70 |
| 4,069,790 | 1/1978 | Witte | 198/494 X |

FOREIGN PATENT DOCUMENTS

| | | | |
|---|---|---|---|
| 2307733 | 11/1976 | France | 198/500 |

*Primary Examiner*—Shrive P. Beck

*Attorney, Agent, or Firm*—Sughrue, Rothwell, Mion, Zinn and Macpeak

[57] ABSTRACT

A method of enamelling sheets (e.g. cooker panels) in which hooks are used to suspend the sheets during the enamelling procedure and in which deposits of enamel are prevented from building up on the hooks by covering them initially with an under-coat of non-pellicular aluminium paint. This has the effect of retaining the enamel that may be deposited on the hooks until after firing (thereby avoiding spoiling the enamel of the sheets with particles of broken hook enamel) but of enabling the enamel to be removed after firing either by heating and quenching the hooks or by vibrating them (or both).

4 Claims, No Drawings

METHOD OF ENAMELLING SHEETS

FIELD OF THE INVENTION

The present invention relates to a method of enamelling sheets, and more particularly to a method of enamelling sheets on a production line.

DESCRIPTION OF THE PRIOR ART

A known method of enamelling sheets on a production line consists in suspending the sheets to be enamelled from a conveyor by means of metal hooks engaged in eyes which pierce the sheets. A layer of a fused mixture of silica and various other materials is then deposited on the sheets, for example, by dusting. The conveyor then passes through a firing furnace in which the deposited layer is transformed into a layer of fired vitrified enamel, adhering to the sheet.

In a variant of this method, the sheets are covered with the mixture in an application line, and are then transferred from this line to a firing line, either manually or mechanically, without touching the sheets.

Since it is not possible to avoid the deposited layer also affecting the hooks, these also are enamelled like the sheets, on leaving the furnace.

When the same hooks are used for several enamelling cycles, the thickness of enamel deposited on the hooks grows rapidly. Therefore they can no longer enter the fixing eyes of the sheets. Further, it can be observed that the thick layer of enamel which covers the hooks snaps in the furnace, and projected fragments of enamel then stick on the sheets whose enamelling is therefore defective. It is thus necessary, after a few cycles, to replace the enamelled hooks by new ones, since in practice it is not possible to remove the enamel from an enamelled hook. Now the replacements of the hooks is burdensome both because of their relatively high cost and because of the cost of the labour necessary for performing the replacement operations.

The aim of the present invention is to improve the abovementioned known method so as to mitigate these drawbacks and to reduce the cost of enamelling sheets.

SUMMARY OF THE INVENTION

The present invention provides a method of enamelling sheets comprising successively the following steps:

depositing an under-coat of non-pellicular aluminium paint on metal hooks;

suspending said sheets on a support by means of said metal hooks;

depositing a layer of a powder constituted by a fused mixture of silica and other materials on the sheets with the layer also covering at least part of said hooks;

firing said layer at a temperature high enough to transform it into a layer of enamel and to cause the enamel deposited on the under-coat cracking during firing; and removing, after firing, the layer of cracked enamel from the hooks.

DESCRIPTION OF THE PREFERRED EMBODIMENT

A method of performing the method in accordance with the invention is described below by way of example.

The sheets to be enamelled, which can for example be the sheets of a cooker, must initially be suspended from a support which in the case of mass production, may be a conveyor of an enamelling line.

The sheets are hung by means of metal hooks which are generally formed from a rod bent into the shape of an S, one loop of the S being engaged in a support carried by the conveyor and the other loop being threaded through an eye pierced in the sheet.

The metal used for making these hooks is either a refractory steel or a special alloy in order for it to be able to withstand the temperature at which the enamel is fired. A suitable enamel for example is constituted principally of 53% iron, 25% chromium and 20% nickel. These steels or alloys are expensive, which means that the price of the hooks is relatively high.

In accordance with a characteristic of the method, the hooks receive an under-coat of non-pellicular aluminium paint before use.

For reference, a non-pellicular aluminium paint is a paint comprising a multitude of aluminium flakes which remain distributed throughout the entire thickness of a layer of the paint. A pellicular aluminium paint, in contrast, is a paint in which the flakes collect at the surface of a layer of paint.

The non-pellicular aluminium paint used in this method is preferably a glycerol-phthalic paint of non-pellicular aluminium.

This paint may be applied by any known means, in particular with a brush, by dipping or by spraying.

After the paint has dried, the sheets are suspended from the hooks which are covered with this under-coat.

A layer formed from a powder of a fused mixture of silica and other materials is then deposited on the sheets. This fused mixture may, for example, comprise essentially: silica; borax; and titanium oxide.

This layer may be deposited by various methods. The powder may be in suspension in water with other matter (clay, mineral salts, organic matter etc . . .) to form a slip which is deposited on the sheets by dipping or by means of a spray gun, the layer of slip then being dried in a drying oven at a temperature in the order of 100° to 150° C. The layer may also be deposited by direct projection of dry powder or by electrophoresis. Whatever the method chosen, it is impossible to avoid having the layer cover at least part of the hooks.

The conveyor then passes into a firing furnace where, at a temperature which depends on the type of enamel used (for example 840° C), the layer of powder is transformed into a layer of enamel. It can then be seen that the layer of enamel which forms on the under-coat of paint covering the hooks cracks during the rise in temperature. At the end of firing, this layer of enamel is fragmented in a multitude of portions which nonetheless continue to adhere to the undercoat.

Examination of the hooks at the end of an enamelling cycle, nonetheless indicates that the presence of the undercoat of paint diminishes greatly the adherence properties of the enamel. The layer of fragmented enamel can thus be easily removed by subjecting the hooks to small repeated mechanical shocks, for example by tapping them or by putting them on a vibrating table.

According to a preferred mode of operation, the enamel on the hooks is completely eliminated by heating the hooks to a temperature higher than ambient and then subjecting them to rapid cooling by quenching in a liquid or by passing them through a jet of liquid, the liquid may be water. These two operations can be performed automatically on the production line without removing the hooks. After the enamel has been eliminated, the hooks may be used again in a subsequent enamelling cycle.

The method described above enables the drawbacks of the method known in the prior art to be mitigated since the same hooks may be used for many enamelling cycles; the risks of defective enamelling of the sheets are reduced since the fragmented enamel covering the hooks adheres thereto during firing and thus the fragments of enamel cannot be projected onto the sheets during enamelling. It also enables the cost to be reduced by removing the need to replace the hooks, the extra investment in an oven to heat the hooks before quenching being a relatively small extra in the cost price of mass production.

A marked improvement of the efficiency of the method in accordance with the invention is noted when the non-pellicular aluminium paint used for the under-coat on the hooks is also a glycerol-phthalic paint.

The method in accordance with the invention may be applied in particular to the mass production of cookers.

What is claimed is:

1. A method of enamelling sheets comprising successively the following steps:

depositing an under-coat of non-pellicular aluminum paint on metal hooks;

suspending said sheets on a support by means of said metal hooks;

depositing a layer of fused enamel component mixture powder on the sheets with the layer also covering at least a part of said hooks;

firing said layer at a temperature high enough to transform it into a layer of enamel and causing the enamel deposited on the under-coat to crack during firing; and removing, after firing, the layer of cracked enamel from the hooks.

2. A method according to claim 1, wherein said non-pellicular aluminium paint is a glycerol-phthalic paint.

3. A method according to claim 1, wherein the removal of the said broken layer is performed by heating the hooks to a temperature above ambient temperature followed by rapid cooling of the hooks thus heated.

4. A method according to claim 1, wherein the removal of the said broken layer is performed by subjecting said hooks to repeated mechanical shocks.

* * * * *